US008744333B2

(12) United States Patent
Tomita

(10) Patent No.: US 8,744,333 B2
(45) Date of Patent: Jun. 3, 2014

(54) IMAGE FORMING APPARATUS HAVING PREREGISTRATION MECHANISM

(75) Inventor: Shigeo Tomita, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 363 days.

(21) Appl. No.: 13/238,620

(22) Filed: Sep. 21, 2011

(65) Prior Publication Data

US 2012/0076564 A1 Mar. 29, 2012

(30) Foreign Application Priority Data

Sep. 28, 2010 (JP) ..... 2010-217297

(51) Int. Cl.
*G03G 15/00* (2006.01)
*B65H 85/00* (2006.01)
*B65H 9/00* (2006.01)

(52) U.S. Cl.
USPC ..... 399/388; 399/394; 399/401

(58) Field of Classification Search
CPC ..... B65H 2301/121; B65H 85/00; G03G 15/6564; G03G 15/6558; G03G 15/6532; G03G 2215/00599
USPC ..... 399/383, 388, 394, 401
See application file for complete search history.

(56) References Cited

U.S. PATENT DOCUMENTS

| | | | | |
|---|---|---|---|---|
| 8,042,806 | B2 * | 10/2011 | Ubayashi | 271/229 |
| 2007/0048032 | A1 * | 3/2007 | Sakai et al. | 399/309 |
| 2012/0070214 | A1 * | 3/2012 | Okutsu | 399/388 |

FOREIGN PATENT DOCUMENTS

| | | | | | |
|---|---|---|---|---|---|
| JP | 06-016262 | A | | 1/1994 | |
| JP | 2000118803 | A | * | 4/2000 | B65H 9/16 |
| JP | 2002-29649 | A | | 1/2002 | |
| JP | 2002-326730 | A | | 11/2002 | |
| JP | 2002370849 | A | * | 12/2002 | B65H 9/00 |
| JP | 2005-096911 | A | | 4/2005 | |
| JP | 2007-058009 | A | | 3/2007 | |
| JP | 2009-249093 | A | | 10/2009 | |

OTHER PUBLICATIONS

Office Action (Notice of Grounds of Rejection) dated Jul. 17, 2012, issued in corresponding Japanese Patent Application No. 2010-217297, and an English Translation thereof. (10 pages).

* cited by examiner

*Primary Examiner* — Daniel J Colilla
(74) *Attorney, Agent, or Firm* — Buchanan Ingersoll Rooney PC

(57) ABSTRACT

A first conveyance path is a path for conveying paper from a paper feed unit to a registration roller. Passage of paper on the first conveyance path is detected by a first sensor and a second sensor. The first sensor detects passage of paper upstream from the second sensor. A second conveyance path is connected to the first conveyance path downstream from a detection position of the second sensor. In response to the first sensor detecting passage of paper, first preregistration correction is performed. In response to the second sensor detecting passage of paper, second preregistration correction is performed. If a first sheet of paper is supplied from the paper feed unit, the first preregistration correction is performed on a second sheet of paper conveyed following the first sheet. If the first sheet is conveyed from the second conveyance path, the second preregistration correction is performed on the second sheet.

5 Claims, 12 Drawing Sheets

PRIOR ART

IMAGE FORMING APPARATUS HAVING PREREGISTRATION MECHANISM

This application is based on Japanese Patent Application No. 2010-217297 filed with the Japan Patent Office on Sep. 28, 2010, the entire content of which is hereby incorporated by reference.

BACKGROUND OF THE INVENTION

1. Field of the Invention

The present invention relates to an image forming apparatus, and more particularly to an image forming apparatus having a preregistration mechanism.

2. Description of the Related Art

In image forming apparatuses, it is desired to convey paper at the shortest possible intervals to achieve high productivity.

When paper conveyance intervals are shortened, it is necessary to accurately align the timings at which paper is conveyed. On the other hand, in a paper conveyance unit, the paper conveyance speed may vary with variations in the paper initial position, variations in the diameter of the conveyance roller, and variations in the surface state of the conveyance path. Various techniques for adjusting those variations have been disclosed.

For example, Document 1 (Japanese Laid-Open Patent Publication No. 2002-029649) discloses a technique for adjusting variations as described above using preregistration correction. Preregistration correction is a process of adjusting a timing at which paper is conveyed to a registration position by temporarily stopping paper upstream from the registration position. Preregistration correction will be described with reference to FIG. 13.

FIG. 13 is an operation diagram showing operation paths of the front and back ends of paper in a conveyance path. In the example shown in FIG. 13, on the conveyance path, a paper feed roller (paper feed R) picking up paper from a paper feed cassette, a paper feed sensor (paper feed S) detecting the fed paper, a conveyance sensor (conveyance S) detecting passage of paper on the conveyance path, a registration sensor (registration S) detecting paper at a registration position, a registration roller (registration R) passing paper, stopping at the registration position, to a prescribed position such as an image forming unit are arranged in this order.

In FIG. 13, line L9A shows a front end position of the first sheet of paper conveyed through the conveyance path, line L9B shows a back end position of the first sheet of paper, line L9C shows a front end position of the second sheet of paper, and line L9D shows a back end position of the second sheet of paper.

When paper is conveyed from the paper feed cassette, the conveyance speed may vary among sheets of paper depending on, for example, the arrangement of paper in the tray or the slip amount of the conveyance roller. In FIG. 13, a variation in the conveyance speed between sheets of paper conveyed from the paper feed cassette is shown by line L91 and line L92. FIG. 13 shows a change of the front position when paper conveyance is stopped as preregistration correction based on that the paper feed sensor detects paper. When the first sheet of paper starts being fed at time T91, paper shown by line L91 arrives at a stop position for preregistration correction (preregistration position) at time T92, and paper shown by line L92 arrives at the preregistration position at time T93. When it is assumed that the arrival time varies in this way, the conveyance from the stop position should be resumed later than time T93 (time T94). In other words, when it is assumed that the time at which paper arrives at the stop position varies, it is necessary that the conveyance should be resumed later than the latest possible time.

When the registration sensor detects the paper after the conveyance of the first sheet of paper is resumed at time T94, the conveyance of the paper is stopped again so that the paper stops before the registration roller (the registration position). A variation in the front end position of paper after resumption of conveyance is shown by lines L93 and L94. The times at which paper shown by lines L93 and L94 reach the registration position are shown by times T95 and T96. The variation in arrival time at the registration position (the interval between time T95 and time T96) is smaller than the variation in arrival time at the preregistration position (the interval between time T92 and time T93). In this manner, preregistration correction can reduce variations of the arrival time at the registration position.

When the paper feed sensor detects the back end of the first sheet, the conveyance of the second sheet is started. The variation in the front position of the second sheet is shown by lines L95 and L96.

Document 2 (Japanese Laid-Open Patent Publication No. 2009-249093) discloses a technique including a sensor for detecting paper on a conveyance path, in which a conveyance speed for each sheet is adjusted by adjusting the conveyance speed based on the time from paper feeding to detection of paper by the sensor.

According to Document 1, although the timing at which paper is conveyed to the registration position can be adjusted, the interval from the preceding paper (the interval between the first sheet and the second sheet) increases. In order to shorten this interval, the distance from the preregistration position to the registration position may be increased, and the conveyance speed from the preregistration position to the registration position may be made higher than the conveyance speed downstream from the registration position. However, if the distance from the preregistration position to the registration position is longer, the variations in the paper arrival timing at the registration position increase, and therefore, the timing at which the conveyance is resumed at the registration position has to be delayed. Accordingly, the interval from the preceding paper increases downstream from the registration position.

In the technique described in Document 1, it is preferable to bring the preregistration position closer to the registration position in order to reduce variations in the arrival timing at the registration position, while it is preferable to increase the distance from the preregistration position to the registration position in order to shorten the interval between sheets. Thus, such contradictory conditions should be considered.

Although the technique described in Document 2 may contribute to higher productivity without stopping paper, it may raise a new problem of variations in conveyance speed, for example, due to accuracy of measurement of the sensor.

SUMMARY OF THE INVENTION

The present invention is made in view of the foregoing problems and aims to provide an image forming apparatus capable of reducing variations in paper conveyance timing while shortening intervals between sheets of paper in conveying paper.

An image forming apparatus in accordance with an aspect of the present invention includes an image forming unit for forming an image on paper, a paper feed unit for conveying paper to the image forming unit, a registration roller for conveying paper to a prescribed position, a first conveyance path for conveying paper from the paper feed unit to the registration roller, a conveyance unit for conveying paper on the first conveyance path, a control unit for controlling the conveyance unit, and a first sensor and a second sensor for detecting passage of paper on the first conveyance path. The first sensor detects passage of paper upstream from the second sensor on the first conveyance path. The image forming apparatus further includes a second conveyance path connected to the first conveyance path downstream from a detection position of the second sensor on the first conveyance path. The control unit performs first preregistration correction in which conveyance of paper is temporarily stopped in response to the first sensor detecting passage of paper and conveyance of the paper is thereafter resumed. The control unit performs second preregistration correction in which conveyance of paper is temporarily stopped in response to the second sensor detecting passage of paper and conveyance of the paper is thereafter resumed. If a first sheet of paper exists on the first conveyance path or the second conveyance path, the control unit determines whether the first sheet is supplied from the paper feed unit to the first conveyance path or supplied from the second conveyance path to the first conveyance path. When it is determined that the first sheet is supplied from the paper feed unit, the control unit performs the first preregistration correction on a second sheet of paper conveyed following the first sheet. When it is determined that the first sheet is supplied from the second conveyance path, the control unit performs the second preregistration correction on the second sheet.

An image forming apparatus in accordance with another aspect of the present invention includes a paper feed unit for accommodating paper, a registration roller for conveying paper to a prescribed position, a first conveyance path for conveying paper from the paper feed unit to the registration roller, a conveyance unit for conveying paper on the first conveyance path, a control unit for controlling the conveyance unit, a sensor for detecting passage of paper on the first conveyance path, and a second conveyance path connected to the first conveyance path downstream from a paper detection position of the sensor. If a first sheet of paper exists on the first conveyance path or the second conveyance path, the control unit determines whether the first sheet is supplied from the paper feed unit to the first conveyance path or supplied from the second conveyance path to the first conveyance path. When it is determined that the first sheet is supplied from the paper feed unit, the control unit conveys a second sheet of paper conveyed following the first sheet to the registration roller without stopping the second sheet. When it is determined that the first sheet is supplied from the second conveyance path, the control unit performs preregistration correction on the second sheet. In the preregistration correction, conveyance of the second sheet is temporarily stopped in response to the sensor detecting passage of the second sheet, and conveyance of the second sheet is thereafter resumed.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
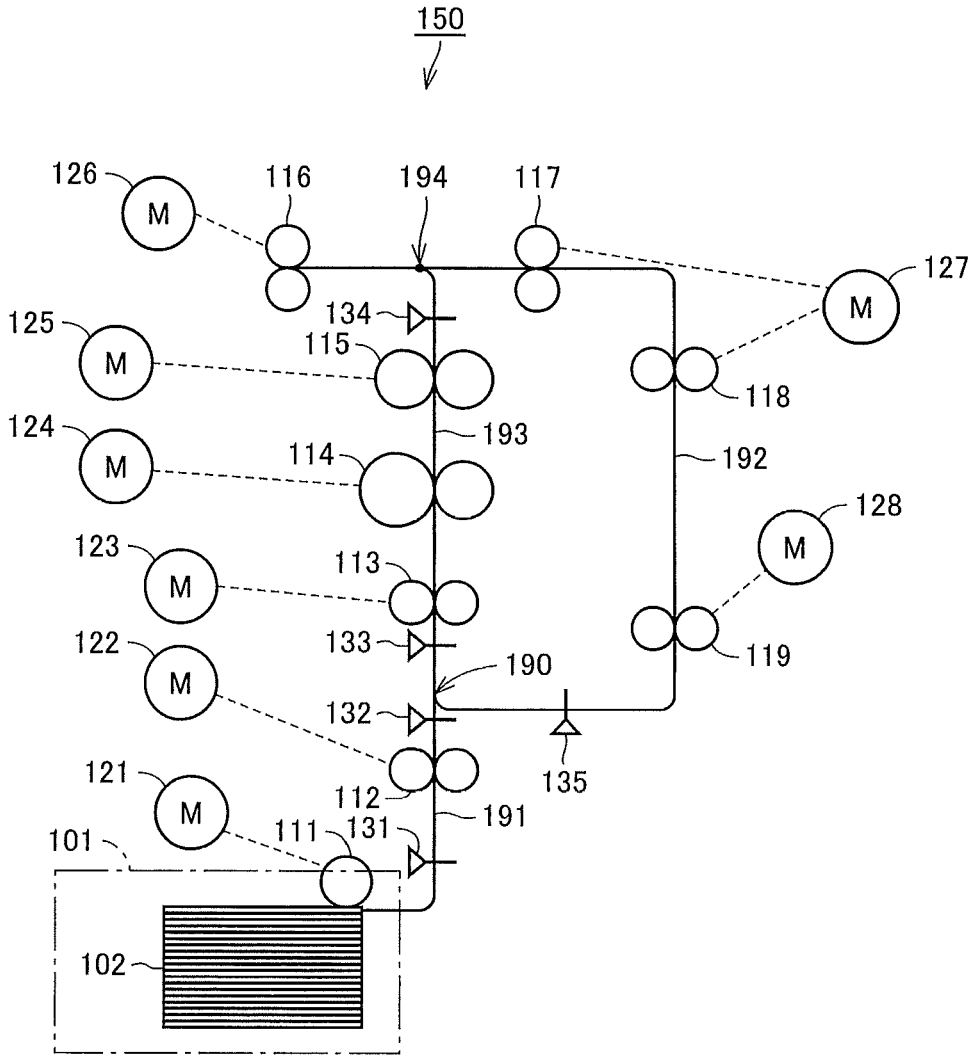
FIG. 1 is a diagram schematically showing a configuration of a print engine in an image forming apparatus in an embodiment of the present invention.

In the following, an image forming apparatus in an embodiment of the present invention will be described in details with reference to the figures. It is noted that in the figures the components having the same functions are denoted with the same reference numerals and a description thereof will not be repeated.

[1. Configuration of Print Engine]

FIG. 1 is a cross-sectional view schematically showing a configuration of a print engine of an image forming apparatus in the present embodiment.

A print engine 150 includes a paper feed cassette 101 accommodating paper 102, a paper feed roller 111 feeding paper 102, a conveyance roller 112 conveying paper fed by paper feed roller 111, and a photoconductor 114 on which a toner image is formed. Print engine 150 further includes a registration roller 113 which passes paper 102 conveyed by conveyance roller 112 or conveyed by a third duplex conveyance roller 119, which will be described later, to photoconductor 114 at a timing adjusted such that paper 102 is in registration with a toner image on photoconductor 114.

Print engine 150 includes a fixing roller 115 for fixing a toner image on paper and a paper exit/reversing roller 116 for discharging paper 102 to the outside of the image forming apparatus or for reversing paper 102 and conveying the reversed paper to a duplex path as described later.

In the configuration of the print engine as described above, the conveyance path of paper 102 from paper feed cassette 101 to paper exit/reversing roller 116 includes a first conveyance path 191 and a third conveyance path 193. Paper feed roller 111 and conveyance roller 112 are arranged on the first conveyance path. The registration roller, the photoconductor, the fixing roller, and paper exit/reversing roller 116 are arranged on third conveyance path 193.

A paper feed sensor 131 and a conveyance sensor 132 are arranged on first conveyance path 191 to detect passage of paper 102 on first conveyance path 191.

Paper feed sensor 131 detects passage of paper 102 between paper feed roller 111 and conveyance roller 112 on first conveyance path 191.

Conveyance sensor 132 detects passage of paper 102 between conveyance roller 112 and a branch point 190.

A registration sensor 133 detects passage of paper 102 between branch point 190 and registration roller 113 on third conveyance path 193.

A paper exit sensor 134 detects passage of paper 102 between fixing roller 115 and a branch point 194 on a second conveyance path.

Branch point 190 and branch point 194 on third conveyance path 193 are connected to one end and the other end of second conveyance path 192, respectively.

A first duplex conveyance roller 117, a second duplex conveyance roller 118, and a third duplex conveyance roller 119 are provided on second conveyance path 192. Paper 102 sent out from fixing roller 115 is passed to paper exit/reversing roller 116 and is then reversed and sent out to second conveyance path 192. Paper 102 sent out to second conveyance path 192 is conveyed to first duplex conveyance roller 117, second duplex conveyance roller 118, and third duplex conveyance roller 119, in this order, and is passed to registration roller 113 through branch point 190.

Print engine 150 further includes a paper feed motor 121 rotating paper feed roller 111, a conveyance motor 122 rotating conveyance roller 112, a registration motor 123 rotating registration roller 113, a photoconductor motor 124 rotating photoconductor 114, a fixing motor 125 rotating fixing roller 115, paper exit/reversing motor 126 rotating paper exit/reversing roller 116, a first duplex conveyance motor 127 rotating first duplex conveyance roller 117 and second duplex conveyance roller 118, and a second duplex conveyance motor 128 rotating third duplex conveyance roller 119.

Print engine 150 also includes a duplex conveyance sensor 135. Duplex conveyance sensor 135 detects passage of paper 102 at a prescribed position between third duplex conveyance roller 119 and branch point 190 on the third conveyance path.

Although the present embodiment is configured to include a plurality of motors for rotating a plurality of rollers described above, the plurality of rollers may be rotated/stopped by one motor and a plurality of clutches.

[2. Block Configuration of Image Forming Apparatus]

Figure 2:
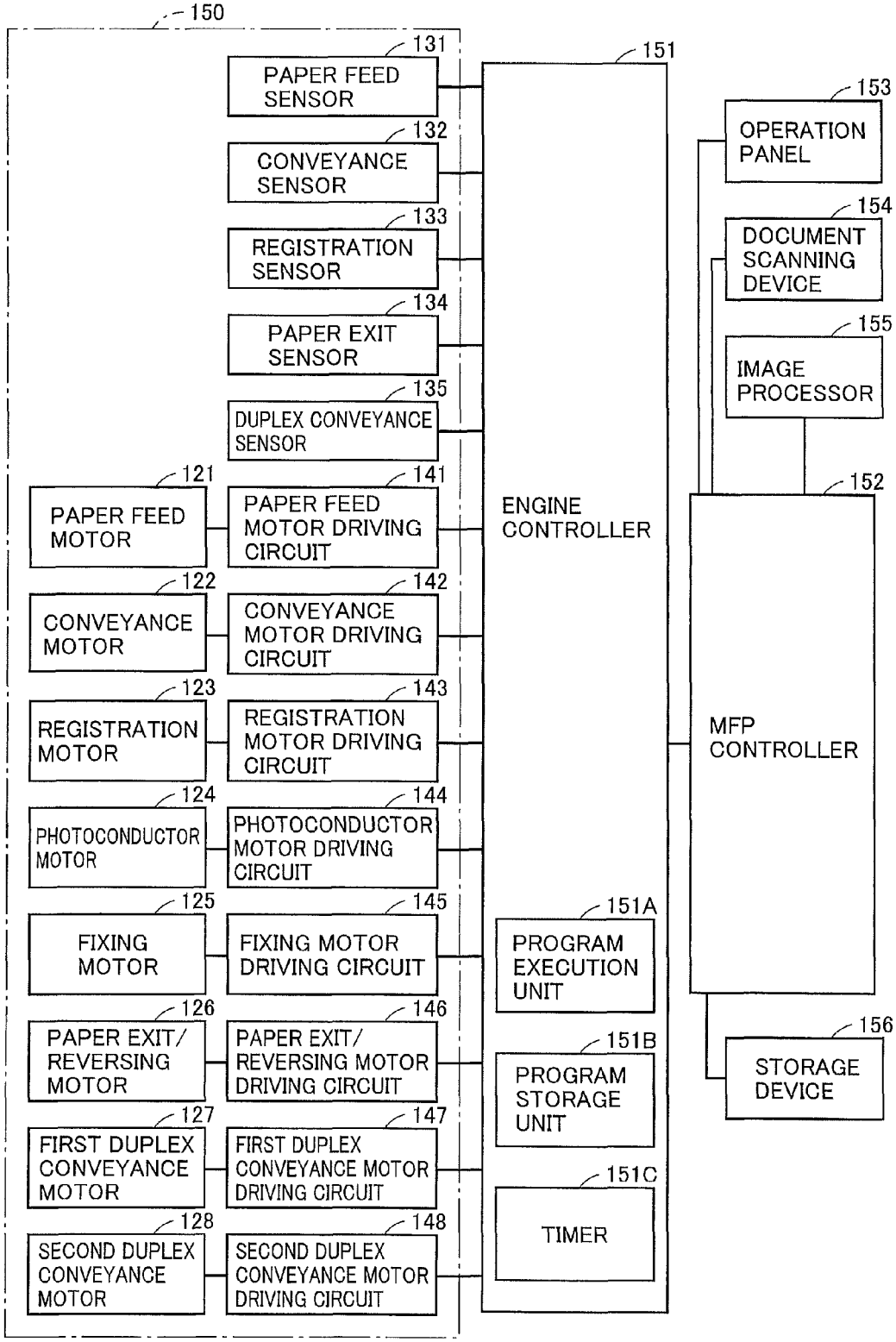
FIG. 2 is a control block diagram of the image forming apparatus in the embodiment of the present invention.

FIG. 2 is a control block diagram of the image forming apparatus in the present embodiment.

Referring to FIG. 2, the image forming apparatus includes print engine 150, an operation panel 153 accepting an externally input operation, an image scanning device 154 such as a scanner, a storage device 156 storing image files and a variety of information, an image processor 155 executing a variety of image processing on image data generated by document scanning device 154 or image data stored in storage device 156, an MFP (Multi Function Peripheral) controller 152 controlling operations of operation panel 153, document scanning device 154, and image processor 155, and an engine controller 151 controlling operation of the image forming apparatus as a whole. Engine controller 151 includes a program storage unit 151B, a program execution unit 151A executing the program stored in program storage unit 151B, and a timer 151C used in a process executed by program execution unit 151A. Engine controller 151 outputs a control signal to print engine 150 and MFP controller 152 in accordance with the program stored in program storage unit 151B.

Print engine 150 includes a paper feed motor driving circuit 141 driving paper feed motor 121, a conveyance motor driving circuit 142 driving conveyance motor 122, a registration motor driving circuit 143 driving registration motor 123, a photoconductor motor driving circuit 144 driving photoconductor motor 124, a fixing motor driving circuit 145 driving fixing motor 125, a paper exit/reversing motor driving circuit 146 driving paper exit/reversing motor 126, a first duplex conveyance motor driving circuit 147 driving first duplex conveyance motor 127, and a second duplex conveyance motor driving circuit 148 driving second duplex conveyance motor 128. Engine controller 151 receives detection outputs from paper feed sensor 131, conveyance sensor 132, registration sensor 133, paper exit sensor 134, and duplex conveyance sensor 135.

In the image forming apparatus in the present embodiment, when an image formation instruction is input to operation panel 153, MFP controller 152 instructs document scanning device 154 to scan a document. In response, document scanning device 154 generates image data of the document and outputs the image data to MFP controller 152.

MFP controller 152 instructs image processor 155 to perform image processing on the image data input as described above in accordance with an instruction input to operation panel 153. In response, image processor 155 executes image processing on the image data and sends back the processed image data to MFP controller 152.

MFP controller 152 then sends the image data generated by document scanning device 154 or the image data obtained by processing the image data at image processor 155, as well as a print instruction (the number of copies, single-sided/double-sided print, a zoom, etc.) input to operation panel 153, to engine controller 151.

Engine controller 151 outputs a print instruction to print engine 150 based on the image data and the print instruction received from MFP controller 152. The print instruction includes an instruction to drive the motors such as paper feed motor 121.

Print engine 150 forms an image on paper 102 in accordance with the instruction sent from engine controller 151. Paper 102 having an image formed thereon is discharged from paper exit/reversing roller 116 to the outside of the image forming apparatus (or an output tray in the image forming apparatus).

[3. Registration Correction]

Figure 3A:
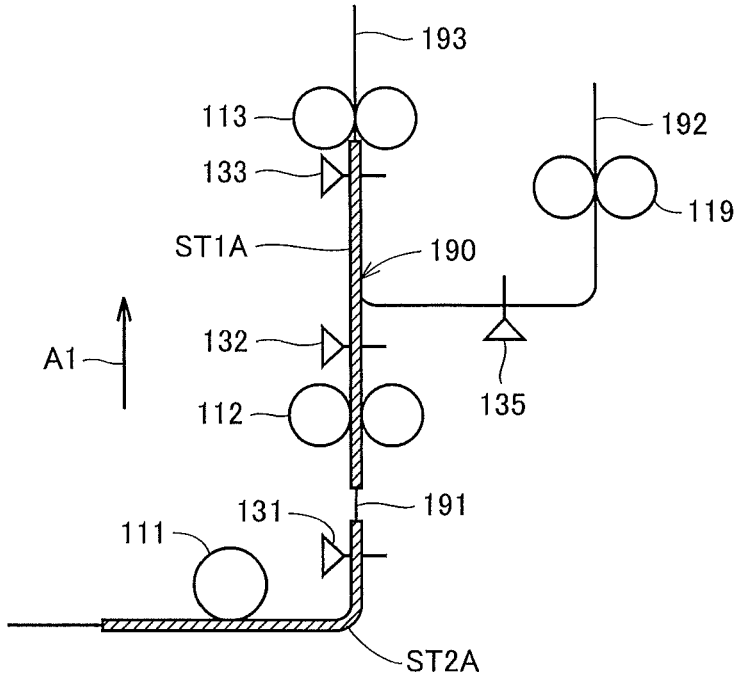
FIG. 3A and FIG. 3B illustrate registration correction and preregistration correction for paper in the image forming apparatus in FIG. 2.

In the present embodiment, registration sensor 133 and registration roller 113 are used to perform registration correction. Specifically, in response to registration sensor 133 detecting passage of paper 102, the rotation of conveyance roller 112 is stopped so that the conveyance of paper is stopped. FIG. 3A shows paper stopped in this manner. FIG. 3A shows the paper conveyance path partially enlarged in print engine 150 shown in FIG. 1. In FIG. 3A, arrow A1 shows the direction in which paper is conveyed on first conveyance path 191 and third conveyance path 193.

In FIG. 3A, paper ST1A is conveyed from paper feed cassette 101 by paper feed roller 111 and conveyance roller 112 from first conveyance path 191 to third conveyance path 193 and has the front end sandwiched by registration roller 113 in response to detection of the front end by registration sensor 133, so that the conveyance is stopped.

In the present embodiment, as described with reference to FIG. 3A, paper is temporarily stopped before being introduced to photoconductor 114, so that the timing at which the paper is introduced to photoconductor 114 is adjusted. This is called registration correction. FIG. 3A shows the state in which registration correction is performed on paper ST1A.

Figure 3B:
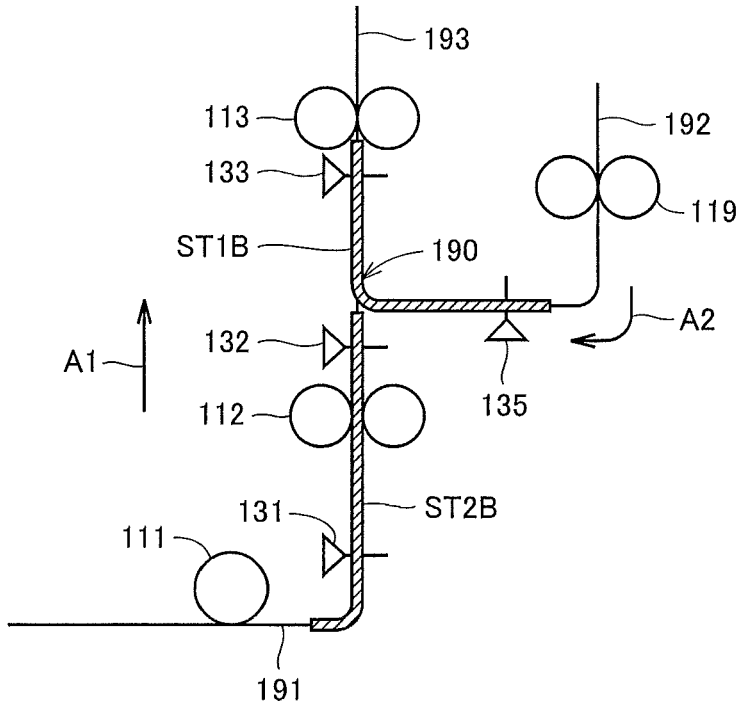

FIG. 3B shows a state in which registration correction is performed on paper conveyed from second conveyance path 192 to third conveyance path 193.

Referring to FIG. 3B, the front end of paper ST1B is sandwiched by registration roller 113, so that paper ST1B is stopped. FIG. 3B shows the state in which registration correction is performed on paper ST1B. When registration correction is performed on paper conveyed from second conveyance path 192 to third conveyance path 193, the temporarily stopped paper has the front end portion located on third conveyance path 193 and the back end portion located on second conveyance path 192, as shown by paper ST1B in FIG. 3B. In FIG. 3B, arrow A2 shows the direction in which paper is conveyed on third conveyance path 193.

In this specification, the "front end" and "back end" of paper are referred to based on the direction in which paper is conveyed on first to third conveyance paths 191 to 193 in print engine 150. In this specification, the stop position of paper by registration correction is referred to as the "registration position" as necessary.

[4. Preregistration Correction]

In the image forming apparatus in the present embodiment, when paper is successively conveyed to photoconductor 114, preregistration correction is performed on paper to be conveyed to photoconductor 114, following paper serving as a target of registration correction. Preregistration correction is performed to reduce variations in paper arrival timing at the registration position as shown in FIG. 3A and FIG. 3B.

In the present embodiment, in preregistration correction, different sensors are used between when the preceding paper is conveyed from first conveyance path 191 to third conveyance path 193 as shown in FIG. 3A and when the preceding paper is conveyed from second conveyance path 192 to third conveyance path 193 as shown in FIG. 3B.

Specifically, as shown in FIG. 3A, when the preceding paper is introduced from first conveyance path 191 to third conveyance path 193, the conveyance of the following paper ST2A is temporarily stopped based on that the front end of the following paper ST2A is detected by paper feed sensor 131. The conveyance of the paper ST2A is resumed at an appropriate timing after the conveyance of the preceding paper ST1A is resumed.

On the other hand, as shown in FIG. 3B, when the preceding paper is conveyed from second conveyance path 192 to third conveyance path 193, the conveyance of the following paper ST2B is temporarily stopped based on that the front end of the following paper ST2B is detected by conveyance sensor 132, which detects passage of paper at a location downstream from paper feed sensor 131 on first conveyance path 191. The conveyance of the paper ST2B is resumed at an appropriate timing after the conveyance of the preceding paper ST1B is resumed.

In the preregistration correction in the present embodiment, when the preceding paper is conveyed from second conveyance path 192 to third conveyance path 193, the conveyance of the following paper is temporarily stopped in response to the front end of the following paper being detected by the sensor which detects passage of paper on first conveyance path 191 on the more downstream side than when the preceding paper is conveyed from first conveyance path 191 to third conveyance path 193. In other words, as shown by the paper ST2A and the paper ST2B in FIG. 3A and FIG. 3B, when the preceding paper is conveyed from second conveyance path 192 to third conveyance path 193, the stop position of the following paper can be set such that the stop position of the paper that is stopped being conveyed by preregistration correction is brought to the more downstream side than when it is conveyed from first conveyance path 191, that is, such that the front end of the following paper comes closer to the front end of the preceding paper.

When the paper stop position by preregistration correction is brought closer the paper stop position by registration correction in this manner, it is possible to reduce variations in the timing of conveyance to the stop position by registration correction among sheets of paper when paper is temporarily stopped by registration correction. Moreover, the conveyance interval between the preceding paper and the following paper can be shortened. In this specification, the paper stop position by preregistration correction is referred to as the "preregistration position" as necessary.

This effect will be described in more detail with reference to the operation diagram in FIG. 4.

Figure 4:
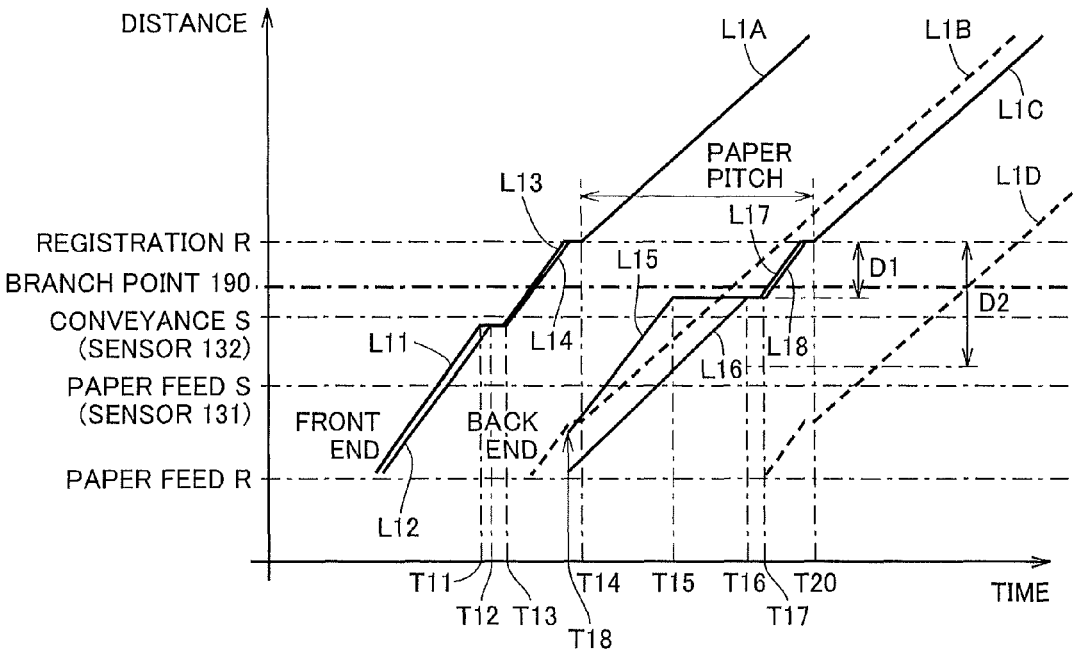
FIG. 4 is an operation diagram of paper conveyed when control in FIG. 3A is performed.

FIG. 4 shows the operation paths of the front and back ends of the preceding paper and the following paper when the preceding paper is conveyed from second conveyance path 192 to third conveyance path 193 in print engine 150 as shown in FIG. 3B.

In FIG. 4, line L1A shows the front end position of the preceding paper, line L1B shows the back end position of the preceding paper, line L1C shows the front end position of the following paper, and line L1D shows the back end position of the following paper. In the example shown in FIG. 4, the preceding paper having the end positions shown by lines L1A and L1B is conveyed through the path (second conveyance path 192) different from that of the following paper having the end positions shown by lines L1C and L1D, until it reaches branch point 190. Therefore, in the case shown in FIG. 4, the preceding paper does not collide with the following paper on the upstream side from branch point 190.

The conveyance of the preceding paper conveyed from second conveyance path 192 to third conveyance path 193 is temporarily stopped by preregistration correction on the upstream side from branch point 190 (on second conveyance path 192). Then, the conveyance is resumed at time T13, and the paper is conveyed to third conveyance path 193.

The preregistration correction on second conveyance path 192 is performed, for example, based on that duplex conveyance sensor 135 detects passage of the frond end of the preceding paper. Lines L11 and L12 in line L1A show a variation in arrival at the stop position by preregistration correction on second conveyance path 192. Specifically, line L11 shows the front end position of the earliest paper that arrives at the stop position, and line L12 shows the front end position of the latest paper that arrives at the stop position. At time T11, the front end of paper shown by line L11 arrives at the preregistration position, and at time T12, the front end of paper shown by line L12 arrives at the preregistration position. The preregistration correction on second conveyance path 192 differs from the preregistration correction on first conveyance path 191 described with reference to FIG. 3A and FIG. 3B, only in that a different sensor is used, and in that when the conveyance of paper is temporarily stopped, the paper stop position is changed with the change of the sensor. Therefore, a detailed description thereof will not be repeated.

The preceding paper is conveyed from second conveyance path 192 to third conveyance path 193 after the preregistration correction, and the conveyance is temporarily stopped for registration correction by registration roller 113 in response to detection of the front end by registration sensor 133.

In line L1A, line L13 shows the front end position of the earliest paper and line L14 shows the front end position of the latest paper, for the preceding paper that is temporarily stopped being conveyed by registration correction. The front end position shown by line L13 and the front end position shown by line L14 are stopped being conveyed at times T11 and T12, respectively, by registration roller 113. Then, at time T14, the conveyance is resumed toward photoconductor 114. It is noted that line L1B shows the back end of paper corresponding to line L14.

The feeding of the following paper is started at time T18. More specifically, at time T18, the rotation of paper feed roller 111 is started in order to convey the following paper from paper feed cassette 101 to first conveyance path 191. The following paper conveyed onto first conveyance path 191 is temporarily stopped being conveyed in response to the front end thereof being detected by conveyance sensor 132. Accordingly, the conveyance of the following paper is temporarily stopped such that the front end thereof stops slightly downstream from the detection position of conveyance sensor 132 and upstream from branch point 190. In line L1C, lines L15 and L16 show a variation of the conveyance timing for the paper conveyed to the preregistration position. Specifically, line L15 shows the earliest front end position that arrives at the preregistration position, and line L16 shows the latest front end position. The paper shown by line L15 arrives at the preregistration position at time T15, and the paper shown by line L16 arrives at the preregistration position at time T16.

Then, at time T17, the conveyance of the following paper is resumed from the preregistration position toward the registration position. In line L1C, lines L17 and L18 show a variation in conveyance of paper conveyed from the preregistration position to the registration position. Specifically, line L17 shows the front end position of the earliest paper, and line L18 shows the front end position of the latest paper. The conveyance of the following paper temporarily stopped by registration correction at the registration position is resumed toward fixing roller 115, at time T20.

In FIG. 4, a distance D1 shows the distance between the front end position of the following paper temporarily stopped by preregistration correction and the front end position of the following paper temporarily stopped by registration correction.

On the other hand, a distance D2 shows the distance from the preregistration position to the registration position of the following paper in the case where the preceding paper is conveyed from first conveyance path 191 to third conveyance path 193 as described with reference to FIG. 3A.

As described with reference to FIG. 3B, in the image foaming apparatus in the present embodiment, when the preceding paper is conveyed from second conveyance path 192 to third conveyance path 193, the stop position of the following paper for preregistration correction can be set to the more downstream side. Accordingly, the distance from the paper front end position at the preregistration position to the paper front end position at the registration position can be shortened (from distance D2 to distance D1), thereby reducing variations in timing at which the following paper is conveyed to the stop position by registration correction.

In the image forming apparatus in the present embodiment, even when the preceding paper is conveyed from first conveyance path 191 to third conveyance path 193 and the following paper is conveyed from second conveyance path 192 to third conveyance path 193, the distance between the paper front end position at the preregistration position of the following paper and the paper front end position at the registration position can be shortened as compared with when both the preceding paper and the following paper are conveyed from first conveyance path 191 to third conveyance path 193.

In the image forming apparatus in the present embodiment, when image formation on both sides of paper is successively carried out, paper to third conveyance path 193 is conveyed alternately from first conveyance path 191 and from second conveyance path 192 in order to reduce the interval between sheets of paper to be conveyed. Specifically, when images are formed on N sheets of paper (where N is three or more), image formation is performed in the following order:

1) the back page of the first sheet (from first conveyance path 191)

2) the back page of the second sheet (from first conveyance path 191)

3) the back page of the third sheet (from first conveyance path 191)

4) the front page of the first sheet (from second conveyance path 192)

5) the back page of the fourth sheet (from first conveyance path 191)

6) the front page of the second sheet (from second conveyance path 192)

7) the back page of the fifth sheet (from first conveyance path 191)

8) the front page of the third sheet (from second conveyance path 192)

9) the back page of the sixth sheet (from first conveyance path 191).

Figure 5A:
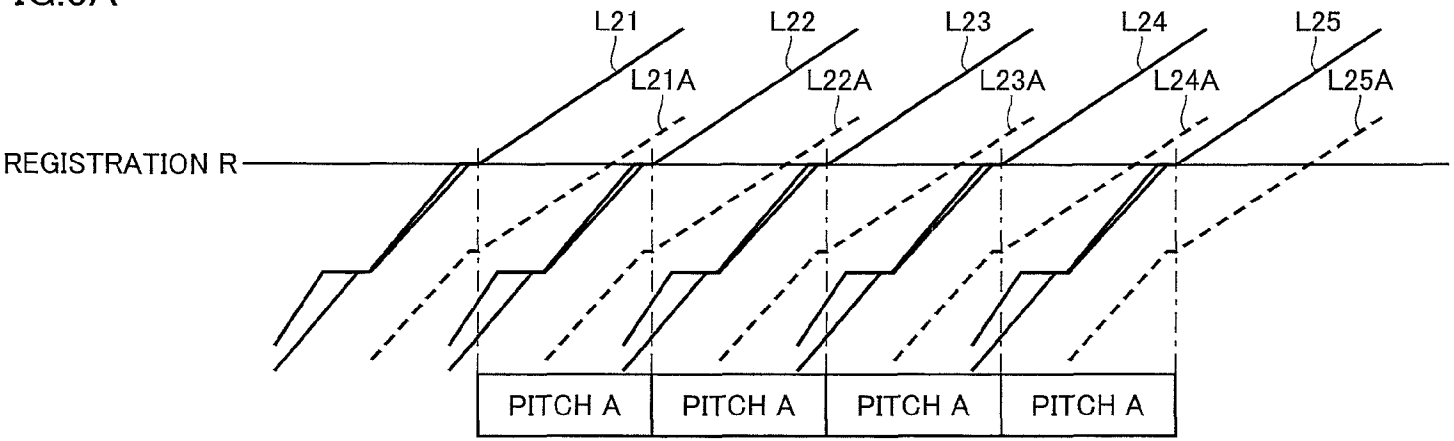
FIG. 5A and FIG. 5B are diagrams illustrating the effect achieved by the print engine in FIG. 1.
Figure 5B:
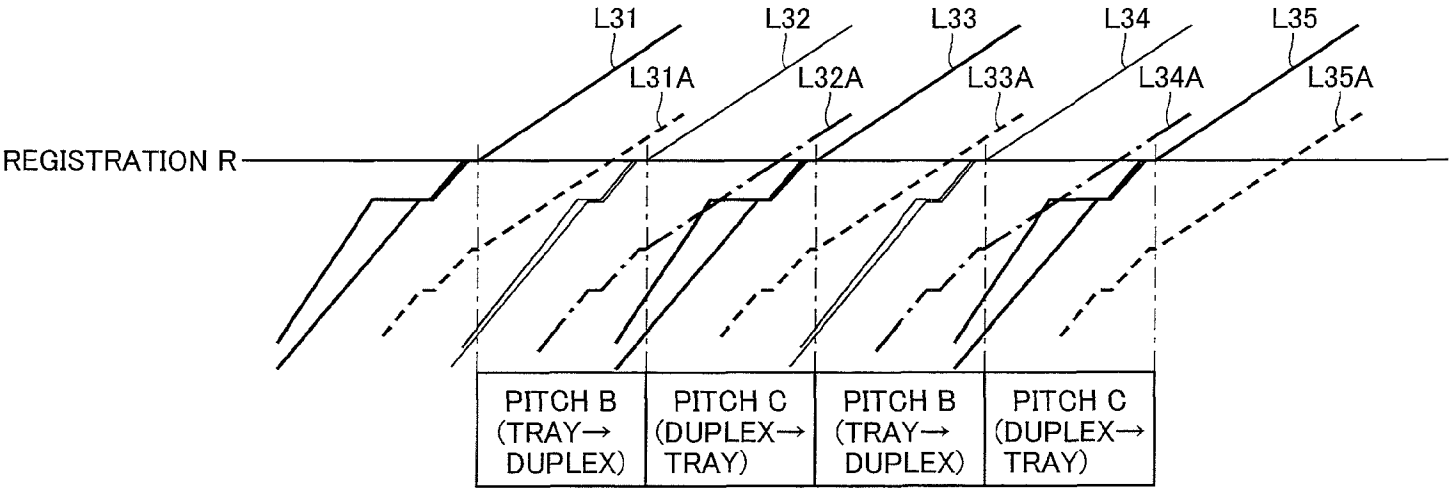

FIG. 5B shows the effect of the shortened interval between sheets as a result of image formation in accordance with the order above.

FIG. 5A shows the timings at which paper is successively conveyed from first conveyance path 191 to third conveyance path 193. FIG. 5B shows the timings of conveyance of paper to registration roller 113 in the case where paper is conveyed to third conveyance path 193 alternately from first conveyance path 191 and from second conveyance path 192.

In FIG. 5A, lines L21, L22, L23, L24, and L25 show the respective front end positions of fives sheets of paper successively conveyed. Lines L21A, L22A, L23A, L24A, and L25A show the respective back end positions of the sheets of paper shown by lines L21, L22, L23, L24, and L25.

In FIG. 5B, lines L31, L32, L33, L34, and L35 show the respective front end positions of five consecutive sheets of paper conveyed by registration roller 113. Lines L31A, L32A, L33A, L34A, and L35A show the respective back end positions of the sheets of paper shown by lines L31, L32, L33, L34, and L35. Lines L31, L33, and L35 show the positions of paper conveyed from first conveyance path 191 to third conveyance path 193, and lines L32 and L34 show the positions of paper conveyed from second conveyance path 192 to third conveyance path 193.

In FIG. 5A, the conveyance interval (time) between consecutive sheets of paper is represented by a pitch A. On the other hand, in FIG. 5B, the interval (time) from when paper is conveyed from first conveyance path 191 to when paper is thereafter conveyed from second conveyance path 192 is represented by a pitch B, and the interval (time) from when paper is conveyed from second conveyance path 192 to when paper is conveyed from first conveyance path 191 is represented by a pitch C.

In the case where paper is successively conveyed to third conveyance path 193, the interval between sheets can be reduced when paper is conveyed alternately from first conveyance path 191 and from second conveyance path 192 rather than when paper is successively conveyed from first conveyance path 191. Therefore, pitch B and pitch C both can be set shorter than pitch A.

Therefore, in the image forming apparatus in the present embodiment, when images are formed on both sides of paper, paper is conveyed to registration roller 113 in the order as shown in FIG. 5B, so that the interval between the conveyed sheets of paper can be shortened as compared with when paper is conveyed successively from first conveyance path 191 to third conveyance path 193.

[5. Paper Conveyance Process]

The image forming apparatus in the present embodiment performs registration correction in which the conveyance of paper is temporarily stopped on third conveyance path 193 so that the timing of conveying paper to photoconductor 114 is adjusted. Well-known techniques can be applied to the adjustment of timing of conveyance of paper to photoconductor 114.

The image forming apparatus in the present embodiment performs preregistration correction in which the conveyance of paper is temporarily stopped upstream from the registration position in order to reduce variations in timing of paper conveyance to the registration position.

Figure 6:
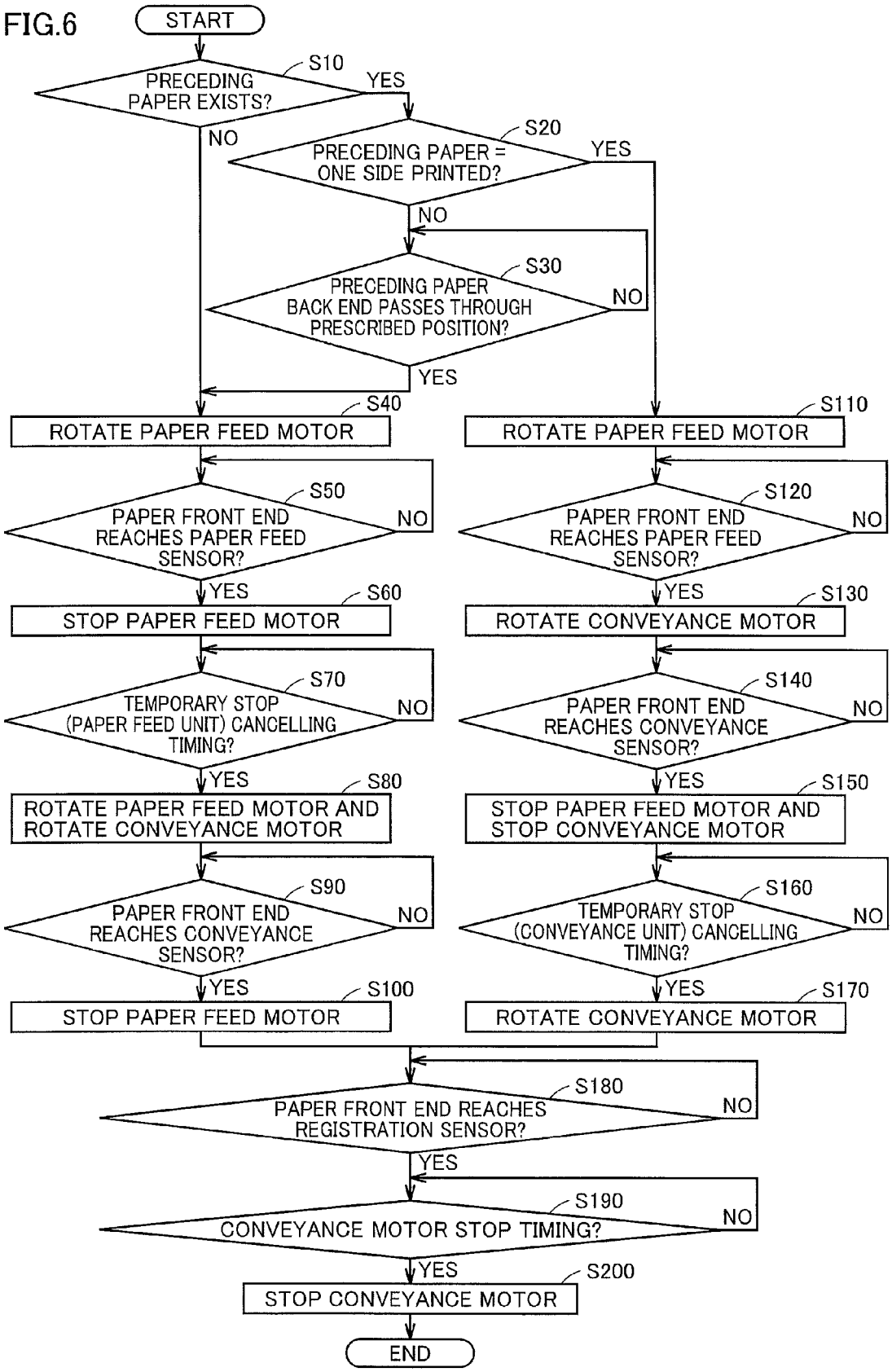
FIG. 6 is a flowchart of a paper conveyance process executed in the print engine in FIG. 1.

The present embodiment is characterized in that the preregistration position is adjusted for paper conveyed from paper feed cassette 101 depending on from where the preceding paper is conveyed. In order to explain this characteristic, the process for conveying paper in print engine 150 (paper conveyance process) will be described below with reference to FIG. 6 showing a flowchart of this process.

When the conveyance of paper from paper feed cassette 101 is started, program execution unit 151A first determines whether the preceding paper exists on first to third conveyance paths 191 to 193 in step S10. If it is determined that it exists, the process proceeds to step S20. If it is determined it does not exist, the process proceeds to step S40.

In the image forming apparatus in the present embodiment, paper feed sensor 131, conveyance sensor 132, registration sensor 133, paper exit sensor 134, duplex conveyance sensor 135, or a not-shown sensor can detect whether paper exists on first to third conveyance paths 191 to 193.

In step S20, program execution unit 151A determines whether the paper that is determined to exist on the conveyance path in step S10 is paper that has an image formed (printed) on one side thereof and that exists on the second conveyance path 192 or is reversed by paper exit/reversing roller 116 to be conveyed to second conveyance path 192 from now on. If it is determined so, the process proceeds to step S110. If it is determined not, the process proceeds to step S30.

In step S30, program execution unit 151A waits until it is detected that the back end of the preceding paper passes through a prescribed position on third conveyance path 193. If it is determined that it passes, the process proceeds to step S40.

Here, a prescribed position is a position where the conveyance of the following new paper from paper feed cassette 101 is permitted to start, and is determined based on the length of first conveyance path 191 and/or third conveyance path 193 and the paper conveyance speed on those conveyance paths.

In step S40, program execution unit 151A starts rotation of paper feed motor 121, and the process then proceeds to step S50. In step S50, program execution unit 151A waits until the front end of the following paper that starts to be conveyed to first conveyance path 191 in step S40 reaches the position detected by paper feed sensor 131. When it is determined that it reaches, the process proceeds to step S60.

In step S60, program execution unit 151A stops paper feed motor 121 to stop rotation of paper feed roller 111, and the process proceeds to step S70. As a result of the process in step S60, the following paper conveyed from paper feed cassette 101 to first conveyance path 191 stops at the stop position by preregistration correction as shown by paper ST2A in FIG. 3A.

In step S70, program execution unit 151A waits until a timing has come to cancel the conveyance stop of the following paper which is stopped in step S60. If it is determined that the timing has come, the process proceeds to step S80. The timing to be determined in step S70 is determined in relation with the conveyance position of the preceding paper. For example, the timing is determined based on that the front end/back end of the preceding paper is on first conveyance path 191 or third conveyance path 193.

In step S80, program execution unit 151A starts rotation of paper feed motor 121 and conveyance motor 122, and the process then proceeds to step S90.

In step S90, program execution unit 151A waits until the front end of the following paper arrives at the detection position of conveyance sensor 132. If it is determined that it arrives, the process proceeds to step S100.

In step S100, program execution unit 151A stops paper feed motor 121 to stop rotation of paper feed roller 111, and the process then proceeds to step S180.

In step S110, program execution unit 151A starts rotation of paper feed motor 121 to start rotation of paper feed roller 111, and the process then proceeds to step S120.

In step S120, program execution unit 151A waits until the front end of the following paper, which starts being conveyed to first conveyance path 191 by starting rotation of paper feed roller 111 in step S110, reaches the detection position of paper feed sensor 131. If it is determined that it reaches, the process proceeds to step S130.

In step S130, program execution unit 151A starts rotation of conveyance motor 122 to start rotation of conveyance roller 112, and the process then proceeds to step S140.

In step S140, program execution unit 151A waits until the front end of the following paper reaches the detection position of conveyance sensor 132. If it is determined that it reaches, the process proceeds to step S150.

In step S150, program execution unit 151A stops rotation of paper feed motor 121 and conveyance motor 122 to stop rotation of paper feed roller 111 and conveyance roller 112, and the process then proceeds to step S160.

As a result of the process in step S150, the following paper stops at the stop position by reregistration correction as shown by paper ST2B in FIG. 3B.

In step S160, program execution unit 151A waits until a timing has come to cancel the conveyance stop of paper in step S150. If it is determined that the timing has come, the process proceeds to step S170. The timing to be determined in step S160 is determined based on the conveyance position of the preceding paper. For example, it is determined that the timing has come, based on the front end/back end of the preceding paper passes through a specific position on third conveyance path 193.

In step S170, program execution unit 151A starts rotation of conveyance motor 122 to start rotation of conveyance roller 112, and the process proceeds to step S180.

In step S180, the process waits until the front end of the "following" paper serving as a target to be conveyed in step S40 to step S170 reaches the detection position of registration sensor 133. If it is determined it reaches, the process proceeds to step S190.

In step S190, the process waits until the timing of stopping conveyance motor 122 has come, and if it is determined that the timing has come, the process proceeds to step S200. The timing in step S190 is determined based on the time from when the front end of paper is detected by registration sensor 133 to when the paper is conveyed to the position where it should be stopped by registration correction. For example, it is determined based on the arrangement of registration sensor 133 on third conveyance path 193 and the conveyance speed of conveyance roller 112.

In step S200, program execution unit 151A stops rotation of conveyance motor 122 to stop rotation of conveyance roller 112. The process then ends. As a result of the process in step S200, the "following paper" serving as a target to be conveyed in step S40 to step S200 stops at the stop position by registration correction as shown by paper ST1A in FIG. 3A.

[6. Paper Pitch Determination Process]

With registration correction as shown by paper ST1A in FIG. 3A and paper ST1B in FIG. 3B, the conveyance of paper is temporarily stopped before paper is conveyed to photoconductor 114, so that the timing of conveying paper to photoconductor 114 is adjusted.

Figure 7:
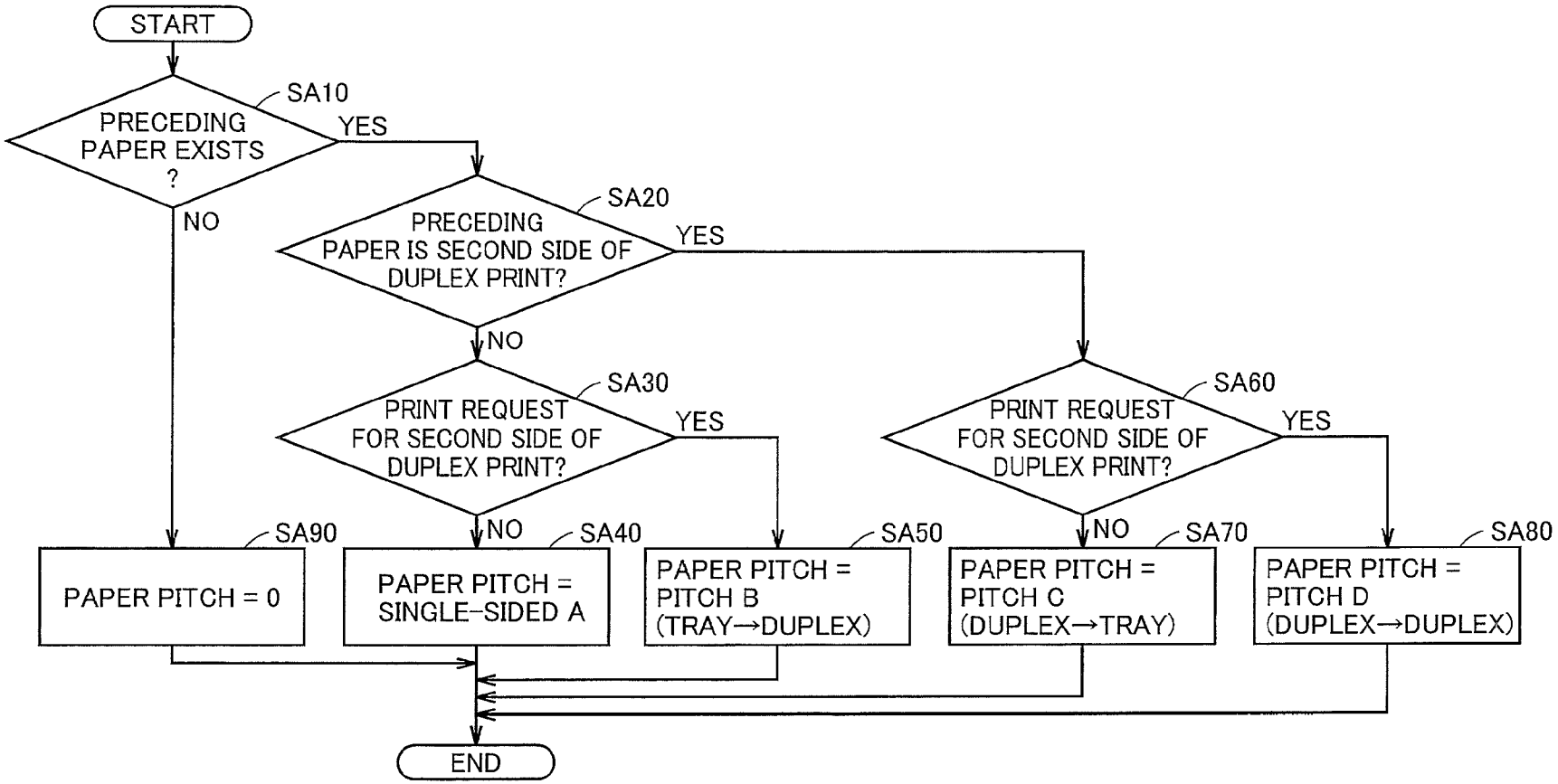
FIG. 7 is a flowchart of a paper pitch adjustment process executed in the print engine in FIG. 1.

Then, in the present embodiment, it is possible to adjust the interval (paper pitch) from when paper is conveyed to photoconductor 114 to when the next paper is conveyed to photoconductor 114. In the following, a process of adjusting a paper pitch (paper pitch adjustment process) will be described with reference to FIG. 7 showing a flowchart of this process.

In the paper pitch adjustment process, program execution unit 151A first determines whether paper that precedes paper being stopped by registration correction exists on third paper conveyance path 193, in step SA10. If it is determined that there exists, the process proceeds to step SA20. If it is determined not, the process proceeds to step SA90.

In step SA90, program execution unit 151A sets the paper pitch to zero, without waiting, stops paper by registration correction, and then conveys the paper to photoconductor 114. The paper pitch adjustment process then ends.

It is noted that the timing of forming a toner image on photoconductor 114 is also adjusted in accordance with the adjustment of paper pitch.

In step SA20, program execution unit 151A determines whether the preceding paper described above is conveyed to photoconductor 114 for printing of the second side of duplex print. If it is determined so, the process proceeds to step SA60, and if it is determined not, the process proceeds to step SA30.

In step SA30, program execution unit 151A determines whether a request to start printing of the second side of duplex print on photoconductor 114 from now on is made for the paper that is at present temporarily stopped being conveyed by registration correction. If it is determined so, the process proceeds to step SA50. If it is determined not, the process proceeds to step SA40.

In step SA40, program execution unit 151A sets the paper pitch to pitch A for single side and terminates the paper pitch adjustment process. Accordingly, the conveyance of the temporarily stopped paper is resumed toward photoconductor 114 on condition that the time defined by pitch A has elapsed since the conveyance of the preceding paper is resumed from the same stop position toward photoconductor 114.

In step SA50, program execution unit 151A sets the paper pitch to pitch B and terminates the paper pitch adjustment process. Accordingly, the conveyance of the paper that is at present stopped by registration correction is resumed toward photoconductor 114 on condition that a time defined by pitch B has elapsed since the preceding paper started being conveyed from the same stop position to photoconductor 114.

In step SA60, program execution unit 151A determines whether a print request for the paper that is at present stopped by registration correction is for printing of the second side of duplex print. If it is determined so, the process proceeds to step SA80. If it is determined not, the process proceeds to step SA70.

In step SA70, program execution unit 151A sets the paper pitch to pitch C and terminates the paper pitch adjustment process.

In step SA80, program execution unit 151A sets the paper pitch to pitch D and terminates the paper pitch adjustment process. Here, pitch D is the conveyance interval (time) when paper is conveyed successively from second conveyance path 192 to third conveyance path 193.

Pitch A to pitch D used in the paper pitch adjustment process are stored beforehand, for example, in a storage unit such as program storage unit 151B.

In the embodiment described above, a paper conveyance apparatus is configured with the parts of print engine 150 except photoconductor 114 and fixing roller 115 for forming an image on paper.

[7. Modification (1)]

In the foregoing embodiment, in the image forming apparatus, both preregistration correction and registration correction are performed on paper supplied from paper feed cassette 101, whether the preceding paper exists or not on first to third conveyance paths 191 to 193. If there exists no preceding paper on first to third conveyance paths 191 to 193, preregistration correction can be omitted for the paper supplied from paper feed cassette 101.

Figure 8:
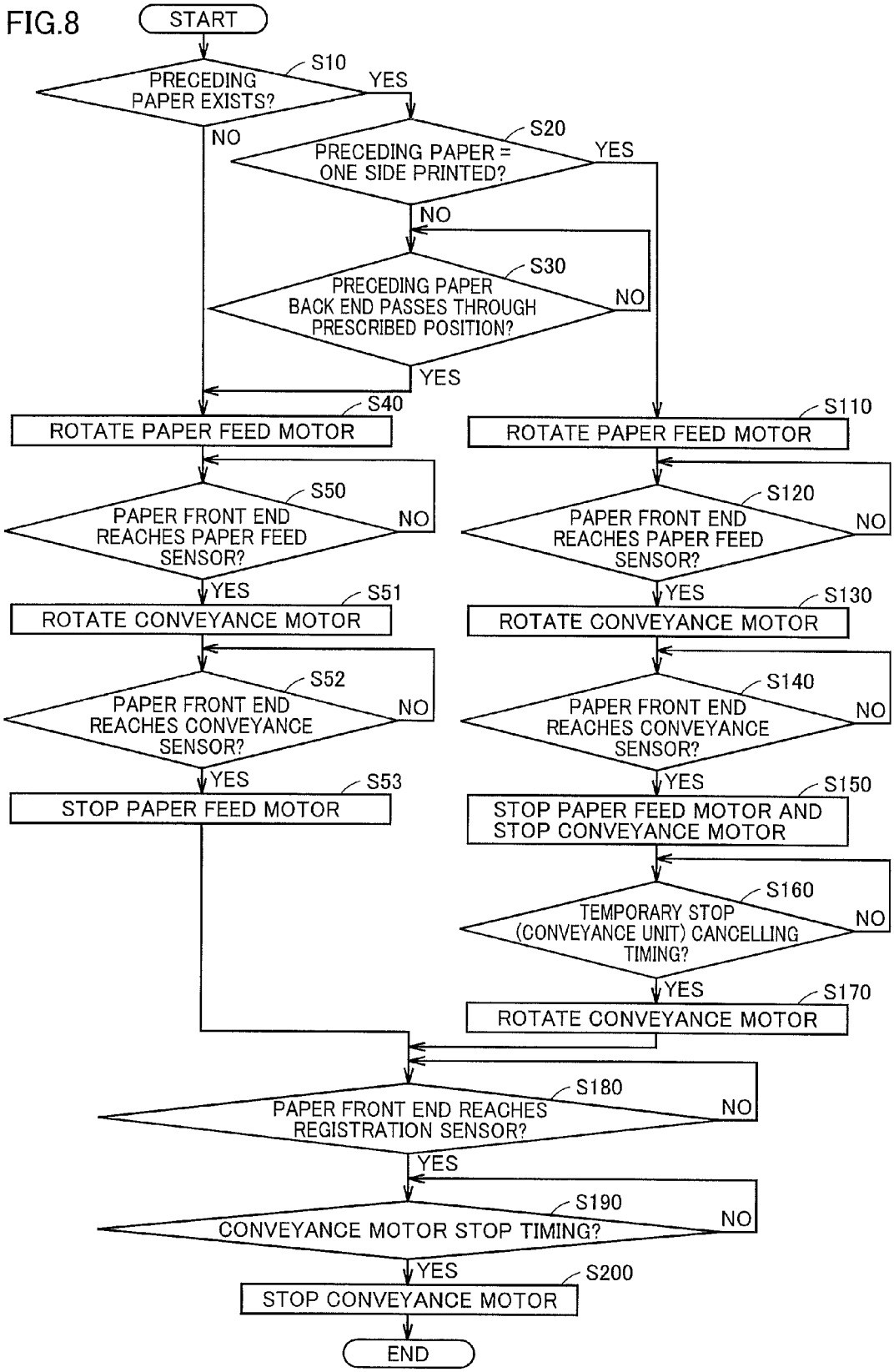
FIG. 8 is a flowchart in a modification to the paper conveyance process in FIG. 6.

The paper conveyance process modified in this manner will be described with reference to FIG. 8 showing a flowchart of this process. In the flowchart of this modification, step S40 to step S100 in the flowchart shown in FIG. 6 are substituted with step S40 to step S53. Only the differences will be described below.

Referring to FIG. 8, it is determined that there exists no preceding paper in step S10, and paper feed motor 121 is rotated and paper feed roller 111 starts being rotated in step S40. Thereafter, in step S50, program execution unit 151A waits until the front end of paper reaches the detection position of paper feed sensor 131, and if it is determined that it reaches, the process proceeds to step S51.

In step S51, program execution unit 151A rotates conveyance motor 122 to rotate conveyance roller 112, and the process then proceeds to step S52.

In step S52, program execution unit 151A waits until the front end of paper reaches the detection position of conveyance sensor 132, and if it is determined that it reaches, the process proceeds to step S53.

In step S53, paper feed motor 121 is stopped to stop rotation of paper feed roller 111. The process then proceeds to step S180.

[8. Modification (2)]

In the image forming apparatus in the present embodiment, paper conveyed from paper feed cassette 101 is temporarily stopped being conveyed by preregistration correction and is temporarily stopped being conveyed by registration correction. Here, when the preceding paper temporarily stopped being conveyed by preregistration correction starts being conveyed again, the conveyance speeds before and after the stop by preregistration correction are preferably adjusted such that the front end of the following paper does not catch up with the back end of the preceding paper.

Here, where the conveyance speed from paper feed cassette 101 to registration roller 113 is V1 (mm/s), the conveyance speed downstream from the registration roller is V2 (mm/s), the interval from when the back end of the preceding paper passes through the detection position of the sensor to when the front end of the following paper passes through the detection position of the sensor is Tpr (sec), the ideal value of the interval therebetween is Tr (sec), and the distance (for example, the distance between front ends of paper) between the position where paper is stopped by preregistration correction and the position where paper is stopped by registration correction is D3 (mm), their relation is preferably given by the equation (1) below:

$$D3/V2-D3/V1 \geq Tpr-Tr \quad (1).$$

It is noted that the sensor mentioned above is the sensor used in preregistration correction, means paper feed sensor 131 when being referred to by FIG. 3A, and means conveyance sensor 132 when being referred to by FIG. 3B.

Figure 9:
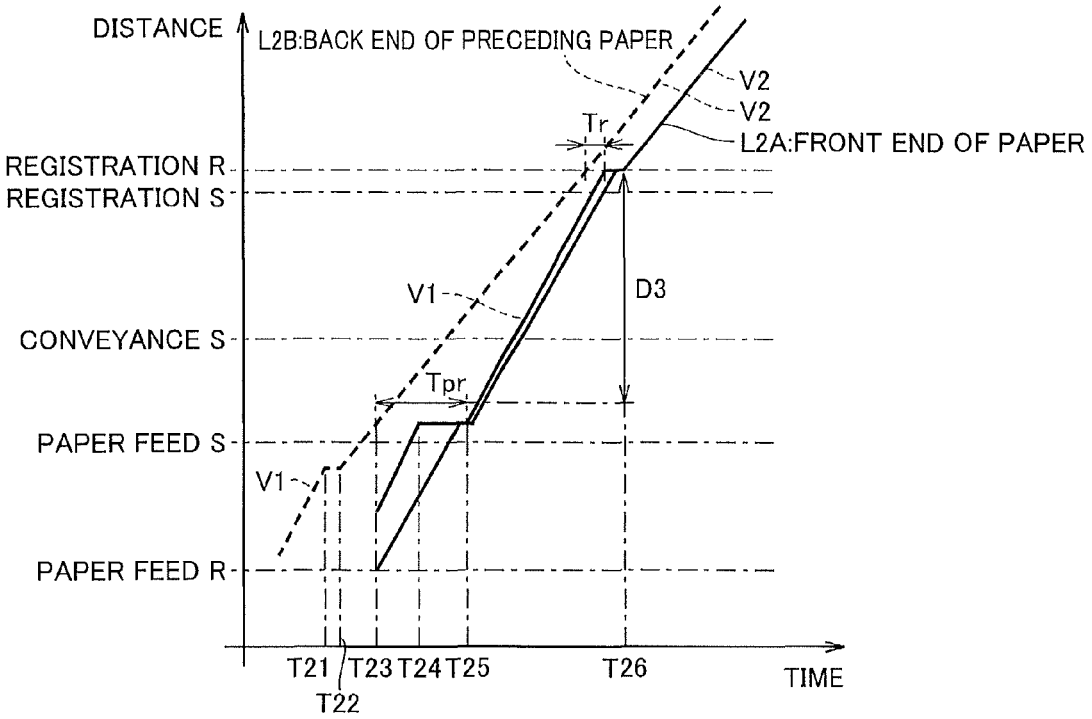
FIG. 9 is a diagram illustrating a modification to the print engine in FIG. 1.

The operation diagram in FIG. 9 shows the operation paths of the back end of the preceding paper and the front end of the following paper, where the speeds are adjusted in this manner.

In FIG. 9, solid line L2A shows the front end position of the following paper, and line L2B shows the back end position of the preceding paper.

Line L2A after time T25 corresponds to the conveyance of paper after the stop by preregistration correction. Line 2B after time T22 corresponds to the conveyance after the stop of conveyance by preregistration correction. Referring to FIG. 9, the preceding paper is conveyed at speed V1 until time T21 and conveyed at speed V2 after time T22. On the other hand, the following paper is conveyed at speed V1 until time T26 and conveyed at speed V2 after time T26. Accordingly, the time Tpr (time period from time T23 to time T25) from passage of the back end of the preceding paper to passage of the front end of the following paper at the stop position of the paper front end by preregistration correction is shortened to Tr which is an interval of passage at registration roller 113.

[9. Modification (3)]

In the image forming apparatus in the present embodiment, when paper is conveyed successively from paper feed cassette 101 to third conveyance path 193, if the actual conveyance speed of the following paper is high, the conveyance speed of the following paper is preferably reduced in order to reliably avoid collision of the following paper with the preceding paper. Such control will be described with reference to FIG. 10.

Figure 10:
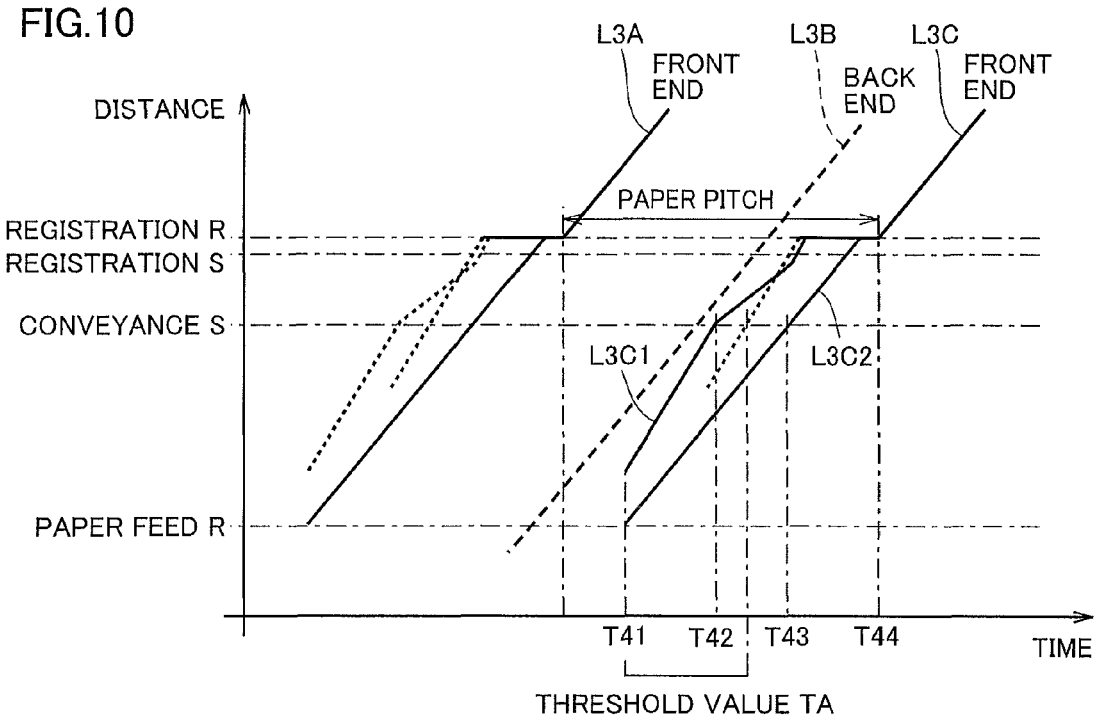
FIG. 10 is a diagram illustrating another modification to the print engine in FIG. 1.

In FIG. 10, line L3A shows the front end position of the preceding paper, line L3B shows the back end position of the preceding paper, and line L3C shows the front end position of the following paper.

In FIG. 10, the following paper starts being conveyed by paper feed roller 111 at time T41. Lines L3C1 and L3C2 show a variation in the conveyance speed of paper conveyed from paper feed roller 111.

The front end of paper shown by line L3C1 reaches the detection position of conveyance sensor 132 at time T42. On the other hand, the front end of paper shown by line L3C2 reaches the detection position of conveyance sensor 132 at time T43.

In the present modification, TA is set as a threshold value of the time required from the start of paper feed to the detection position of conveyance sensor 132. The required time (T42-T41) for paper shown by line L3C1 is shorter than threshold value TA, and the required time (T43-T41) for paper shown by line L3C2 is longer than threshold value TA.

In the present embodiment, when the required time is shorter than threshold value TA, the speed of conveyance from the preregistration position to the registration position is reduced as compared with when the required time is equal to or longer than threshold value TA.

As a result of such adjustment of the conveyance speed, in line L3C1 in FIG. 10, the speed is reduced after passage of the detection position of conveyance sensor 132. Such control can reliably avoid collision between consecutive sheets of paper in print engine 150.

On the other hand, when the required time of the following paper exceeds a specific threshold value longer than threshold value TA, control may be performed such that the speed of conveyance from the preregistration position to the registration position for the following paper is increased. Such control can avoid an unnecessarily longer interval between the preceding paper and the following paper.

[10. Modification (4)]

In the image forming apparatus in the present embodiment, as described with reference to FIG. 3A, when the preceding paper is conveyed from paper feed cassette 101 and the following paper is also conveyed from paper feed cassette 101, the conveyance speed of the following paper is preferably adjusted in accordance with the conveyance speed of the following paper.

Figure 11:
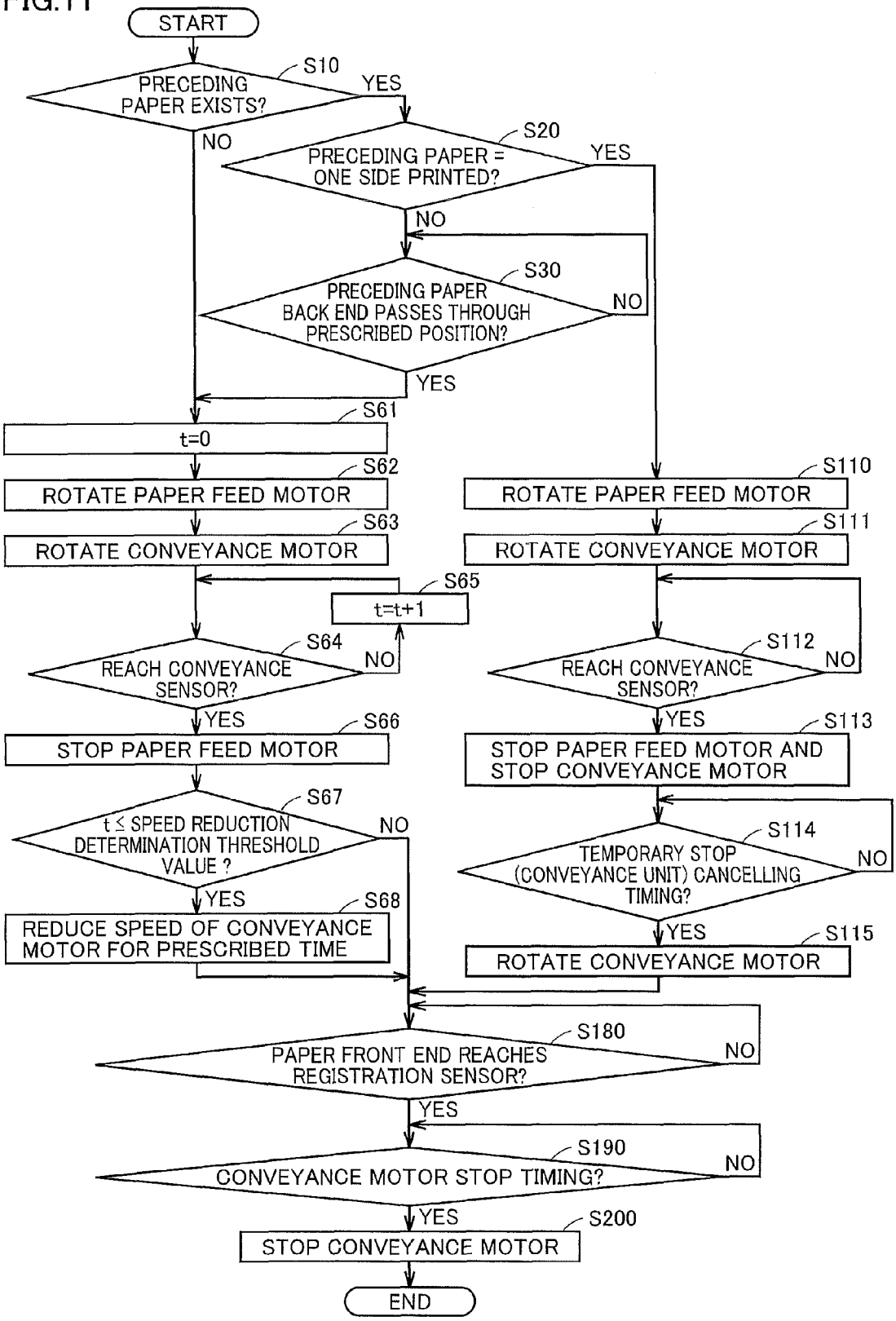
FIG. 11 is a flowchart of another modification to the paper conveyance process in FIG. 6.

The paper conveyance process modified in this manner will be described with reference to FIG. 11 showing a flowchart of this process. In the flowchart in the present modification, step S40 to step S100 in the flowchart shown in FIG. 6 are substituted with step S61 to S68 and step S110 to step S170 in FIG. 6 are substituted with step S110 to step S115. Only the differences will be described below.

Referring to FIG. 11, if it is determined that there exists no preceding paper on first to third conveyance paths 191 to 193, or if it is determined that the preceding paper exists on the conveyance paths and the back end thereof passes through a prescribed position, program execution unit 151A resets a count value of a timer to zero in step S61, and the process then proceeds to step S62.

In step S62, program execution unit 151A rotates paper feed motor 121 to rotate paper feed roller 111, and the process then proceeds to step S63.

In step S63, program execution unit 151A rotates conveyance motor 122 to rotate conveyance roller 112, and the process then proceeds to step S64.

In step S64, program execution unit 151A determines whether the front end of paper reaches the detection position of conveyance sensor 132. If it is determined that it has not yet reached, the count value of the timer is incremented by one in step S65. The process then returns to step S64. On the other hand, if it is determined that it reaches, the process proceeds to step S66.

Accordingly, the timer counts the time from when paper starts being conveyed in step S62 to when the front end of the paper reaches the detection position of conveyance sensor 132.

In step S66, program execution unit 151A stops paper feed motor 121 to stop rotation of paper feed roller 111, and the process then proceeds to step S67.

In step S67, program execution unit 151A determines whether the count value of counter T is equal to or smaller than a predetermined speed reduction determination threshold value. If it is determined so, the process proceeds to step S68. If it is determined not, the process proceeds to step S180.

In step S68, program execution unit 151A reduces the speed of rotation of conveyance motor 122 for a prescribed time, and the process then proceeds to step S180. Accordingly, the conveyance speed of the following paper is reduced for a prescribed time.

The degree of speed reduction in step S68 may be predetermined or it may be set such that the degree of speed reduction is greater as the count value of counter t increases.

If it is determined that the preceding paper exists on first to third conveyance paths 191 to 193, and then if it is determined that the preceding paper has an image formed (printed) on one side thereof, program execution unit 151A rotates paper feed motor 121 to rotate paper feed roller 111 in step S110. The process then proceeds to step S111.

In step S111, program execution unit 151A rotates conveyance path 122 to rotate conveyance roller 112, and the process then proceeds to step S112.

In step S112, program execution unit 151A waits until the front end of paper reaches the detection position of conveyance sensor 132, and if it is detei mined that it reaches, the process proceeds to step S113.

In step S113, program execution unit 151A stops paper feed motor 121 to stop rotation of paper feed roller 111, and in addition, stops rotation of conveyance motor 122 to stop rotation of conveyance roller 112. The process then proceeds to step S114.

As a result of the process in step S113, the following paper is temporarily stopped being conveyed at the stop position by preregistration correction as shown by paper ST2B in FIG. 3B.

In step S114, program execution unit 151A waits until a timing has come to cancel the conveyance stop by preregistration correction. If it is determined that the timing has come, the process proceeds to step S115.

The determination of the timing in step S114 is made similarly to step S160.

In step S115, program execution unit 151A rotates conveyance motor 122 to rotate conveyance roller 112, and the process then proceeds to step S180.

As a result of the process in step S115, the conveyance of paper temporarily stopped by preregistration correction is resumed.

[11. Modification (5)]

In print engine 150 in the present embodiment, a first conveyance path for conveying paper from the paper feed unit to the registration roller is configured with first conveyance path 191 and third conveyance path 193. A second conveyance path, which is connected to the first conveyance path on the downstream side from the detection position of the second sensor on the first conveyance path, is configured with second conveyance path 192.

In the foregoing embodiment, the second conveyance path (second conveyance path 192) is configured with a path through which paper reversed by paper exit/reversing roller 116 is conveyed in order to foam an image on both sides of paper.

The conveyance path connected as the second conveyance path is not limited to the path for duplex print.

Figure 12:
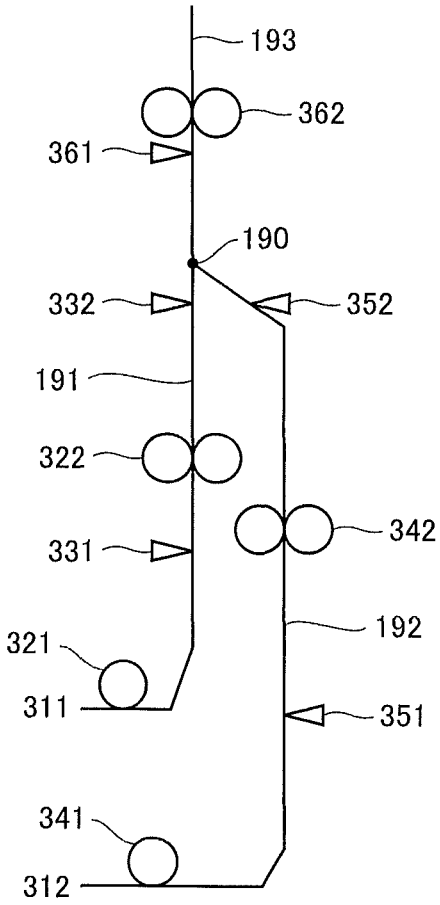
FIG. 12 is a diagram showing a modification to the configuration of the print engine in FIG. 1.
Figure 13:
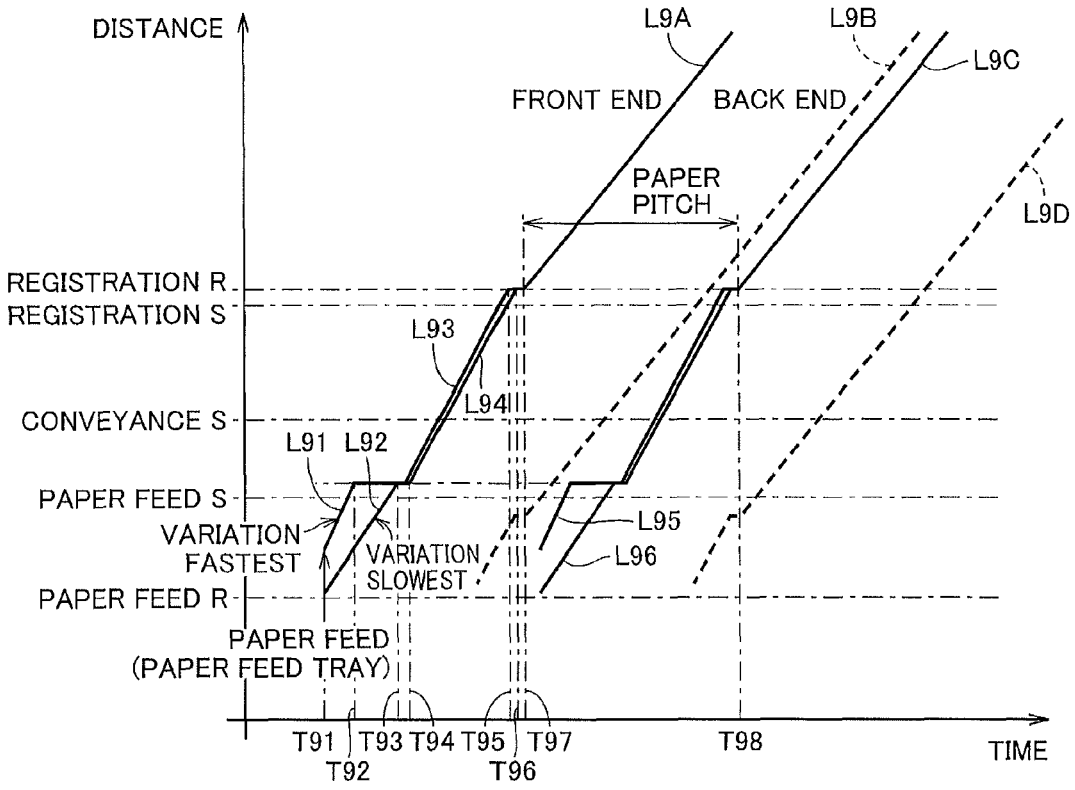
FIG. 13 is a diagram illustrating preregistration correction in an image forming apparatus of the related art.

FIG. 12 shows a modification to the configuration of first to third conveyance paths 191 to 193 in the present embodiment.

In the present modification, paper is conveyed from a plurality of paper feed cassettes (a first paper feed cassette 311 and a second paper feed cassette 312) to third conveyance path 193.

First conveyance path 191 is a paper conveyance path from first paper feed cassette 311 to branch point 190. Second conveyance path 192 is a paper conveyance path from second paper feed cassette 312 to branch point 190. Third conveyance path 193 is a conveyance path downstream from branch point 190.

In first conveyance path 191, a paper feed roller 321, a first paper sensor 331, a conveyance roller 322, and a second paper sensor 332 are arranged in this order. The present modification includes a not-shown motor for rotating paper feed roller 321 and conveyance roller 322.

In second conveyance path 192, a paper feed roller 341, a first paper sensor 351, a conveyance roller 342, and a second paper sensor 352 are arranged in this order.

In the present modification, when the front end of paper reaches the detection position of registration sensor 361, the registration correction process temporarily stops the conveyance such that the front end portion of the paper is sandwiched by registration roller 362.

When paper is conveyed successively from first paper feed cassette 311, the conveyance of the preceding paper is temporarily stopped by registration correction, and the conveyance of the following paper is temporarily stopped by preregistration correction based on that the front end of the following paper reaches the detection position of first paper sensor 331.

A description will now be made to a case where the preceding paper is fed from second paper feed cassette 312 and the following paper is conveyed from first paper feed cassette 311. Paper in second paper feed cassette 312 is conveyed by paper feed roller 341 and conveyance roller 342 to third conveyance path 193. Then, when the front end of the paper reaches the detection position of registration sensor 361, the conveyance of the paper is temporarily stopped by registration correction such that the front end is sandwiched by registration roller 362. Then, following this paper, paper in first paper feed cassette 311 is a target to be conveyed and is conveyed downstream on first conveyance path 191 by paper feed roller 321 and conveyance roller 322. Then, when the front end of the paper reaches the detection position of second paper sensor 332, the conveyance of this following paper is temporarily stopped by preregistration correction.

In summary, in this modification, first paper sensor 331 and second paper sensor 332 are used for preregistration correction when paper in first paper feed cassette 311 is conveyed. Specifically, in the case where the preceding paper is conveyed from first paper feed cassette 311, in response to the front end position of the following paper reaching the detection position of first paper sensor 331, the conveyance of the following paper is temporarily stopped by preregistration correction. On the other hand, in the case where the preceding paper is conveyed from second paper feed cassette 312, when the following paper is conveyed from first paper feed cassette 311, in response to the front end of the following paper reaching the detection position of second paper sensor 332, the conveyance of the paper is temporarily stopped by preregistration correction.

Second paper sensor 332 detects passage of paper downstream from first paper sensor 331 on first conveyance path 191. Then, in the present modification, when the preceding paper is conveyed from a different paper feed cassette, in preregistration correction for the following paper, the conveyance of the following paper is temporarily stopped on condition that the front end position of the following paper reaches the sensor having a detection position on the more downstream side.

The effects of the embodiment described above will now be described.

In image formation, when the preceding paper is fed from the paper feed unit to the first conveyance path, the following paper supplied from the paper feed unit to the first conveyance path similarly should be conveyed after a sufficient interval in order to avoid collision with the preceding paper.

On the other hand, when the preceding paper is fed from the second conveyance path to the first conveyance path, the back end of the preceding paper does not collide with the front end of the following paper temporarily stopped by the second preregistration correction. Therefore, the following paper can be conveyed with a reduced interval from the preceding paper as compared with when the preceding paper is fed from the paper feed unit to the first conveyance path.

Therefore, according to the foregoing embodiment, when the preceding paper is fed from the second conveyance path to the first conveyance path, the preregistration position of the following paper can be brought closer to the registration position. In other words, the interval between the following paper and the preceding paper can be shortened while the preregistration position of the following paper can be brought closer to the registration position.

In the foregoing embodiment, preregistration correction may be performed only when the preceding paper is fed from the second conveyance path to the first conveyance path, and the preregistration position in the preregistration correction can be brought closer to the registration position while the interval between the following paper and the preceding paper is shortened as described above.

Therefore, the present embodiment can provide an image forming apparatus that performs preregistration correction in which intervals between sheets of paper can be shortened while variations in the paper conveyance timing are reduced.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image foaming apparatus comprising:

an image forming unit for forming an image on paper;

a paper feed unit for conveying paper to said image forming unit;

a registration roller for conveying paper to a prescribed position;

a first conveyance path for conveying paper from said paper feed unit to said registration roller;

a conveyance unit for conveying paper on said first conveyance path;

a control unit for controlling said conveyance unit;

a first sensor and a second sensor for detecting passage of paper on said first conveyance path, said first sensor detecting passage of paper upstream from said second sensor on said first conveyance path; and a second conveyance path connected to said first conveyance path downstream from a detection position of said second sensor on said first conveyance path, wherein said control unit performs first preregistration correction in which conveyance of paper is temporarily stopped in response to said first sensor detecting passage of paper and conveyance of the paper is thereafter resumed, said control unit performs second preregistration correction in which conveyance of paper is temporarily stopped in response to said second sensor detecting passage of paper and conveyance of the paper is thereafter resumed, if a first sheet of paper exists on said first conveyance path or said second conveyance path, said control unit determines whether said first sheet is supplied from said paper feed unit to said first conveyance path or supplied from said second conveyance path to said first conveyance path, when it is determined that said first sheet is supplied from said paper feed unit, said control unit performs said first preregistration correction on a second sheet of paper conveyed following said first sheet, and when it is determined that said first sheet is supplied from said second conveyance path, said control unit performs said second preregistration correction on said second sheet.

2. The image forming apparatus according to claim 1, wherein said control unit starts conveyance of paper again at a first timing from the stop by said first preregistration correction and starts conveyance of paper again at a second timing from the stop by said second preregistration correction.

3. The image forming apparatus according to claim 1, wherein said control unit performs control such that a first speed of conveyance from said first sensor to said registration roller is higher than a second speed of conveyance downstream from said registration roller.

4. The image forming apparatus according to claim 3, wherein a distance from said first sensor to said registration roller is equal to or longer than a distance in which a paper interval put by said first preregistration correction can be reduced when paper is conveyed at said first speed of conveyance.

5. The image forming apparatus according to claim 1, wherein said second conveyance path is a conveyance path for duplex print for conveying paper having an image formed on a first side thereof by said image forming unit to said image forming unit for forming an image on a second side of the paper.

* * * * *